US009683811B1

(12) United States Patent
Warensford

(10) Patent No.: US 9,683,811 B1
(45) Date of Patent: Jun. 20, 2017

(54) LOW-PROFILE FOLDING SIGHT WITH ADJUSTABLE APERTURE

(71) Applicant: Spike's Tactical, LLC, Apopka, FL (US)

(72) Inventor: Wayne Richard Warensford, Deland, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 15/192,240

(22) Filed: Jun. 24, 2016

(51) Int. Cl.
*F41G 1/00* (2006.01)
*F41G 1/16* (2006.01)

(52) U.S. Cl.
CPC ..... *F41G 1/16* (2013.01)

(58) Field of Classification Search
CPC ..... F41G 1/16
USPC ..... 42/138
See application file for complete search history.

(56) References Cited

U.S. PATENT DOCUMENTS 1,161,281 A * 11/1915 Barnes et al. ..... F41G 1/16 42/136
1,455,071 A * 5/1923 Browning ..... F41G 1/16 42/138
1,586,413 A 5/1926 Doombos
1,621,476 A * 3/1927 Green ..... F41G 1/08 42/137
1,908,019 A * 5/1933 Howard ..... F41G 1/17 42/139
3,930,316 A * 1/1976 Tellie ..... F41G 1/17 42/140
5,533,292 A * 7/1996 Swan ..... F41G 1/16 42/123
D526,380 S * 8/2006 Swan ..... D22/109
7,356,962 B2 * 4/2008 Swan ..... F41G 1/065 42/133
7,726,229 B2 6/2010 Schwerman et al.
7,814,699 B2 * 10/2010 Storch ..... F41G 1/08 42/137
8,015,744 B1 * 9/2011 Swan ..... F41G 1/065 42/133
D690,778 S * 10/2013 Lee ..... D21/573
8,621,775 B2 * 1/2014 Troy ..... F41G 1/17 42/140
D704,792 S * 5/2014 Fitzpatrick ..... D22/108
D720,828 S * 1/2015 Faifer ..... D22/108
D724,691 S * 3/2015 Barfoot ..... D22/109
2009/0071056 A1 3/2009 Storch et al.
2011/0308133 A1 * 12/2011 Nemec ..... F41G 1/26 42/137
2015/0128471 A1 * 5/2015 Troy ..... F41G 1/08 42/111

* cited by examiner

*Primary Examiner* — Samir Abdosh

(57) ABSTRACT

Disclosed is a low-profile folding sight assembly having a base configured to be secured to a gun and an arm mounted on the base for pivotal movement between at least a folded position and a deployed position. A first sighting aperture having a first size is provided adjacent a distal end of the arm. A selector member on the arm has a second sighting aperture of a second size and is slidably movable between at least a first position in which the first sighting aperture is unobstructed and a second position in which the second sighting aperture is aligned with the first sighting aperture to present a reduced-size sighting aperture.

9 Claims, 7 Drawing Sheets

LOW-PROFILE FOLDING SIGHT WITH ADJUSTABLE APERTURE

FIELD OF THE INVENTION

This invention relates to a low-profile, folding rear sight for a firearm. In particular, it provides a rear sight with an adjustable aperture whose setting can be maintained when the sight is moved to a folded position.

BACKGROUND OF THE INVENTION

Firearm (and air gun) sighting systems that simply align a forwardly positioned element with a rearwardly positioned element are generally known as "iron" sights and exclude the use of optics, such as telescopic or reflex sights. Typically, the forward sight element is a post, bead, or blade that is visually aligned with a notch or circular hole that is part of the rear sight element. A rear sight that uses a circular opening is often referred to as an aperture sight. In many cases, the forward element is vertically adjustable so that alignment of the sights can be vertically adjusted relative to the bore of the firearm barrel (elevation adjustment). Also in many cases, the rear sight element is adjustable side to side so that alignment of the two sight elements can be adjusted horizontally relative to the barrel bore axis (windage adjustment).

Aperture sights utilize a tendency of the human eye to automatically center the front sight when looking through the rear aperture. A larger aperture allows the shooter to more quickly align the sights, while a smaller aperture allows the shooter to more precisely align the sights. Some aperture sights allow the user to select the aperture size, depending on the shooting situation or environmental conditions, thus giving the aperture sighting system more flexibility and a wider range of utility.

Iron sights are inherently more durable than optical sights, which include glass lenses that can be damaged, or reflex sights, which require electrical power for illumination. Some users of optical or reflex sights also equip their firearm with a set of back-up iron sights (BUIS), which may be used under conditions where the optical or reflex sight is either inappropriate or inoperable. In some cases, the back-up iron sights are positioned in alignment with an optical sight, but are foldable in order to maintain a lower profile until deployment is needed.

Prior foldable back-up iron sights in which the rear element includes an adjustable size aperture sight, the adjustment is made by rotating elements having varied aperture size into and out of the line of view. These rotating mechanisms typically occupy a larger amount of space than a single aperture sight or require the element to be moved to a particular aperture setting when the sight is folded to a reduced profile position.

SUMMARY OF THE INVENTION

The present invention provides a low-profile folding sight assembly having a base configured to be secured to a gun and an arm mounted on the base for pivotal movement between at least a folded position and a deployed position. A first sighting aperture having a first size is provided adjacent a distal end of the arm. A selector member on the arm has a second sighting aperture of a second size and is slidably movable between at least a first position in which the first sighting aperture is unobstructed and a second position in which the second sighting aperture is aligned with the first sighting aperture to present a reduced-size sighting aperture.

The selector member may be slidably connected to the arm with a dovetail groove engagement for movement toward and away from the distal end. It may also include a selector detent member configured to secure the selector member against inadvertent movement. According to one embodiment, the arm may be in the folded position while the selector member is in either position. The sight assembly may further comprise an arm detent member configured to retain the arm at the folded and deployed positions.

An embodiment may include the arm being adjustably positionable laterally relative to the base. Laterally positionable attachment of the arm to the base may include a laterally extending, rotatable mounting pin threadedly engaged with the arm such that rotation of the mounting pin causes lateral movement of the arm relative to the base. The assembly may include at least one detent for retaining the mounting pin at selected rotational positions.

The sight assembly may also include indicia on at least one of the base and the arm to indicate relative lateral position of the arm and base.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawing, wherein.

DETAILED DESCRIPTION OF THE INVENTION

Figure 1:
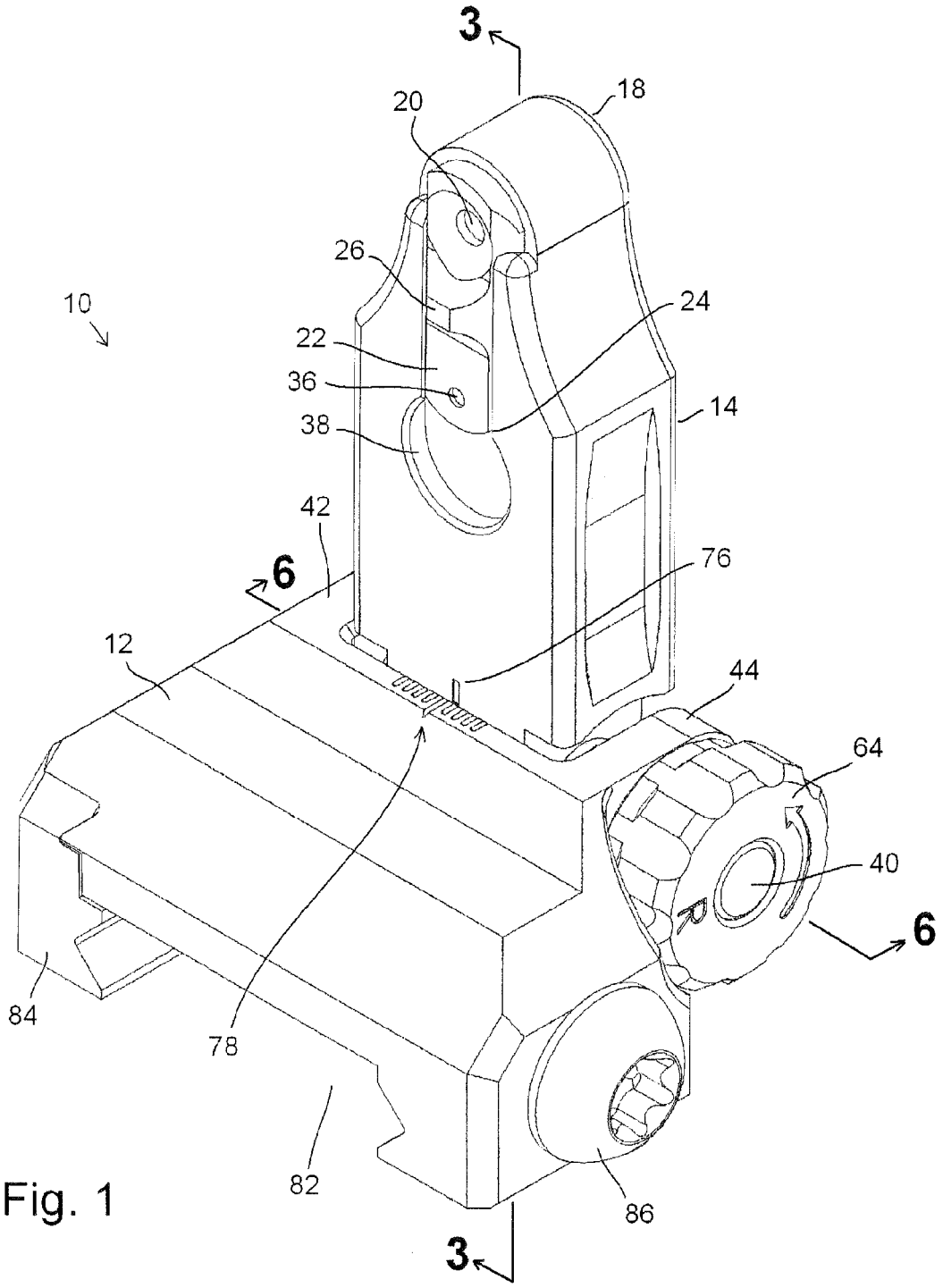
FIG. 1 is an isometric view of the rear sight in an unfolded or deployed position with the aperture at a first setting.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring to the various figures of the drawing, and first to FIG. 1, therein is shown at 10 a low-profile folding sight assembly according to one embodiment of the present invention. The assembly 10 includes a base portion 12 that may be attachable to a firearm (or air gun) via a mounting rail (not shown in FIG. 1) or other means of attachment. Pivotally attached to the base portion 12 is an arm portion 14.

Figure 2:
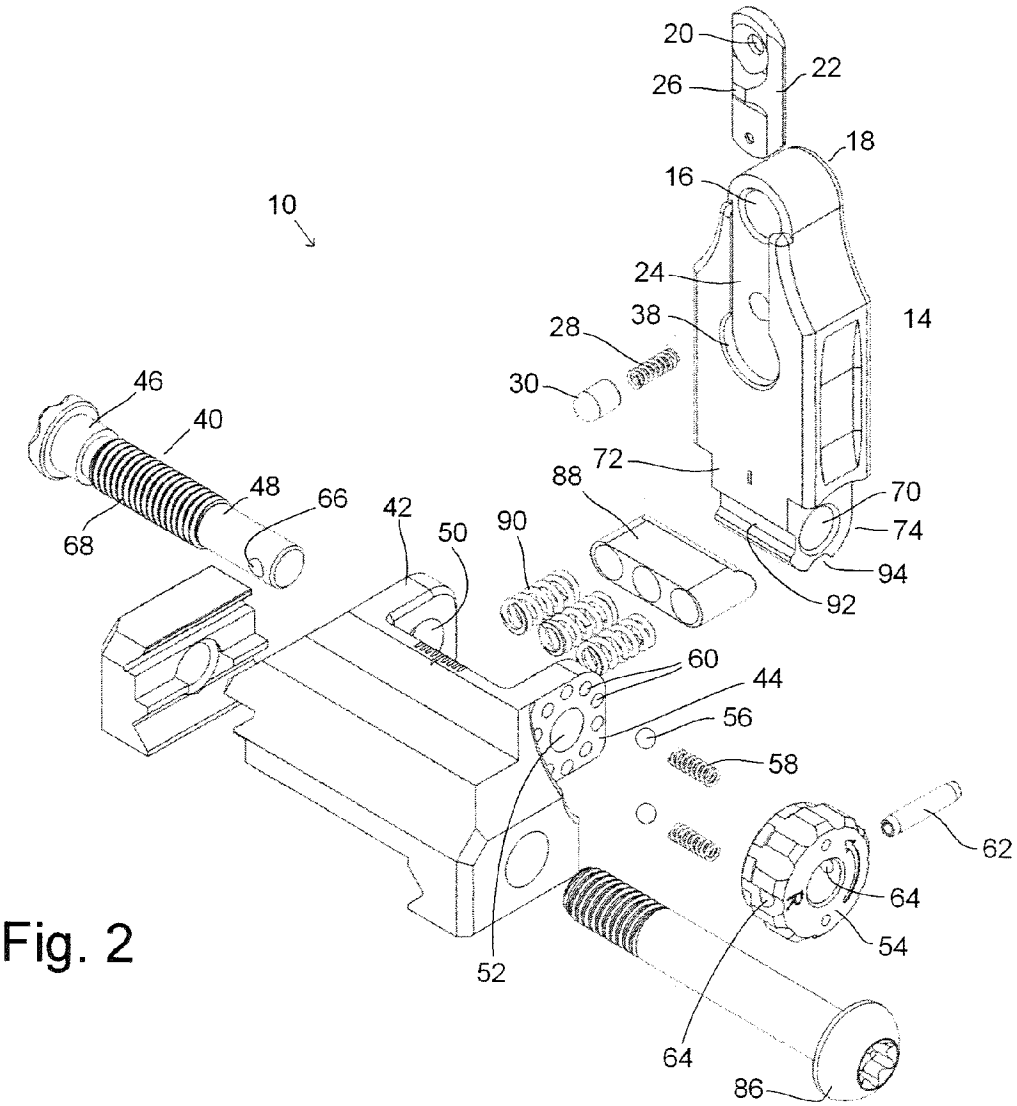
FIG. 2 is an exploded isometric view thereof.
Figure 3:
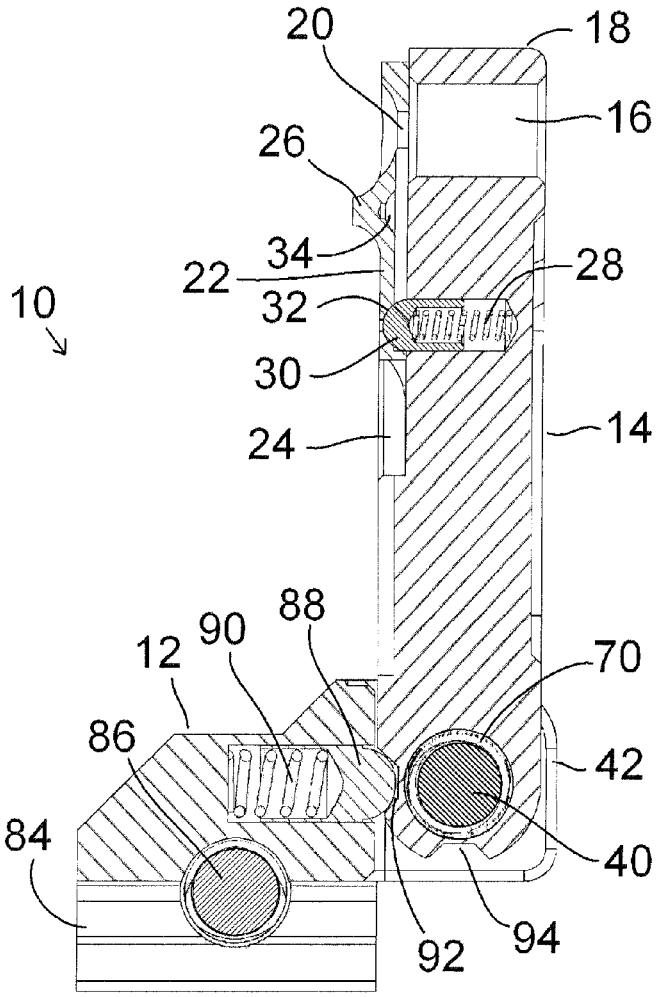
FIG. 3 is a side sectional view taken substantially along line 3-3 of FIG. 1.

Referring now also to FIGS. 2 and 3, the arm portion 14 includes a main aperture 16 at or near its distal end 18. When the sight assembly 10 is used as a rear sight element and the arm portion 14 is in an upwardly extended, deployed position (as shown in FIGS. 1 and 3), the user can visually align the aperture 16 with a front sight element (not shown) for sighting the gun. As will be described in further detail below, the arm portion 14 may be folded (FIGS. 6 and 7) when not in use so as to be out of the way and greatly reduce the profile of the sight assembly 10.

According to one aspect of the present invention, the diameter of the sighting aperture may be selected between at least two different sizes. A first, and typically larger, diameter aperture may be provided by the main aperture 16. A small diameter, secondary aperture 20 may be selected by slidably positioning a selector member 22 carried by the arm portion 14. The selector member 22 may be fitted to the arm portion 14, such as in a dovetail groove 24.

Figure 5:
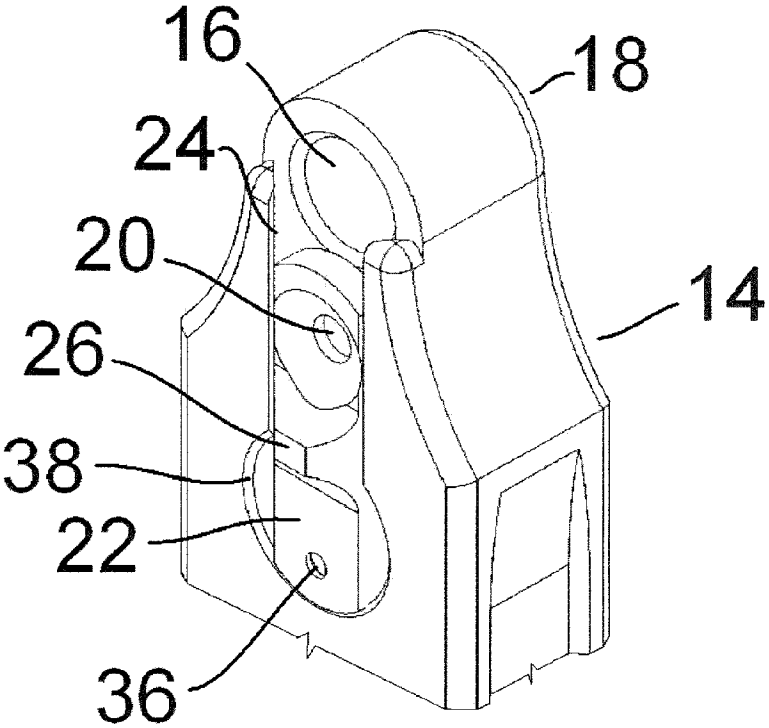
FIG. 5 is like FIG. 4, except with the aperture adjustment in a second position.
Figure 4:
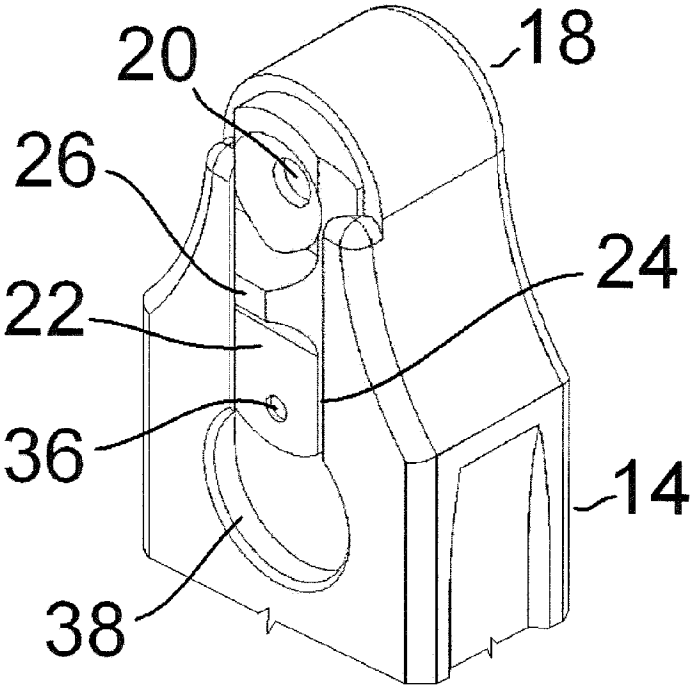
FIG. 4 is an enlarged fragmentary isometric view of the sight aperture adjustment in the first position.

Referring now also to FIGS. 4 and 5, the selector member 22 may be moved to a first position (FIG. 4) in which the secondary aperture 20 is axially aligned with the main aperture 16, or may be moved to a retracted position (FIG. 5) in which the full diameter of the main aperture 16 is unobstructed. The selector member 22 may include a raised tab 26 to facilitate manipulation by a user's fingers without use of a tool. The selector member 22 can be retained in either or both of its positions by a spring-biased detent 28, 30 that releasably engages a first or second detent socket 32, 34 formed in the underside of the selector member 22. A through-opening 36 may be provided in or both of the detent sockets 32, 34 to allow debris to escape or to allow the detent 30 to be depressed with a tool for facilitating installation or removal of the selector member 22 on the arm portion 14. An enlarged base area 38 at the proximal end of the dovetail groove 24 may be provided for ease of manufacture and/or to allow displacement or escape of debris that may accumulate and might otherwise prevent movement of the selector member 22.

Figure 6:
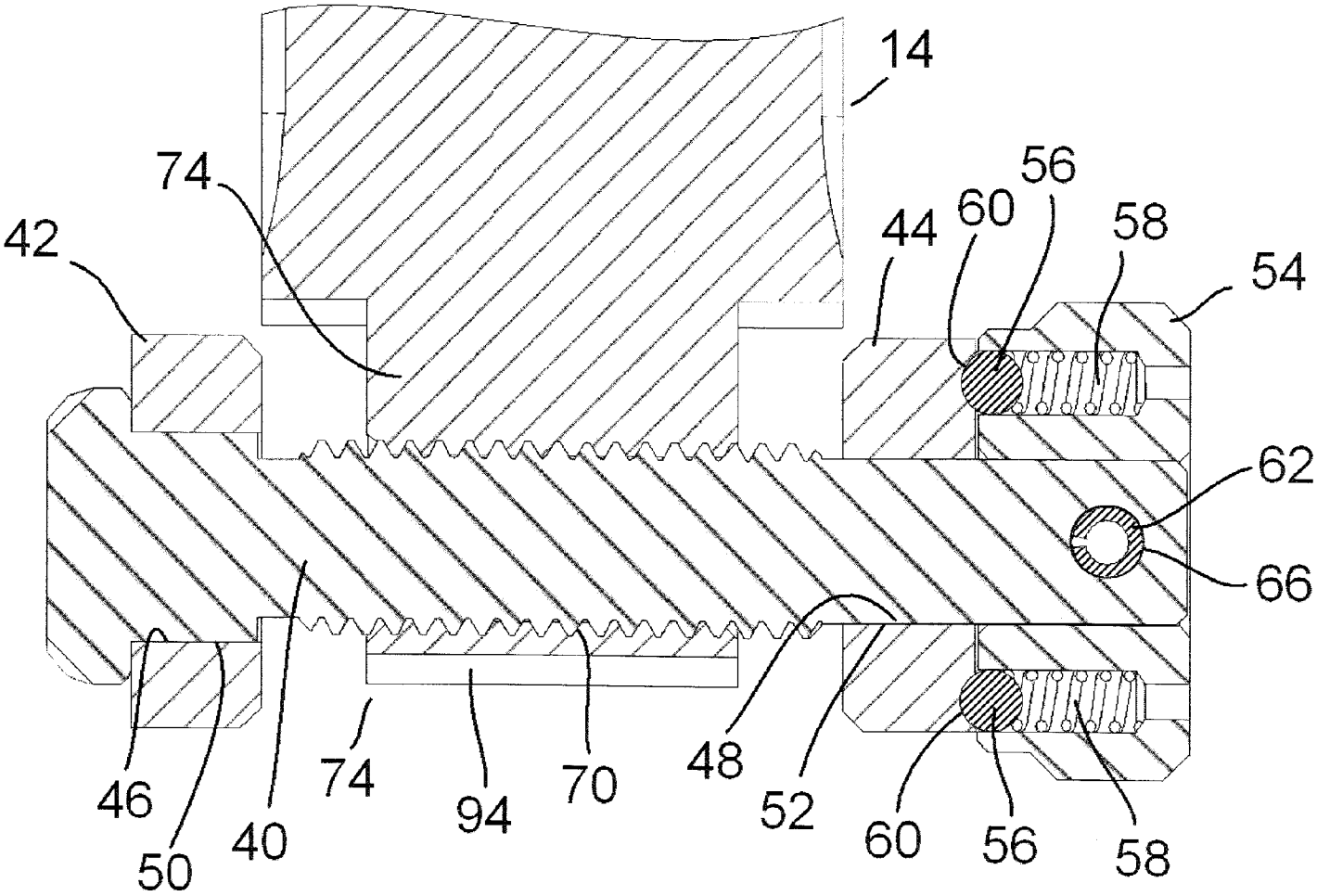
FIG. 6 is a fragmentary sectional view taken substantially along line 6-6 of FIG. 1.

In order to allow windage adjustment, the arm portion 14 may be mounted to the base portion 12 in a manner that allows selective lateral movement and positioning of the arm portion 14 relative to the base portion 12. For example, the arm portion 14 may be carried with a threaded engagement on a laterally extending mounting pen 40. The mounting pin 40 is rotatably carried by a pair of laterally spaced apart mounting ears 42, 44. The mounting pin 40 may include first and second unthreaded bearing surfaces 46, 48 that fit into openings 50, 52 in the mounting ears 42, 44 and allow the mounting pin 40 free rotation therein. The rotationally position of the mounting pin 40 may be controlled by a detent cap 54 attached to one or both ends. The detent cap 54 may include ball detents 56 that are biased by springs 58 into engagement with a circumferentially positioned series of detent sockets 60. The detent cap 54 may be fixed in position relative to the mounting pin 40 by any means that secures it against axial or rotational displacement, such as by means of locked threads and/or a roll pin 62 extending through opposed openings in the detent cap 54 and an opening 66 in an end of the mounting pin 40. As shown in FIG. 6, engagement between the threads 68 of the mounting pin 40 and a threaded through-opening 70 in an extension portion 72 at a proximal end 74 of the arm portion 14 causes the arm portion 14 to be adjustably moved side to side as the mounting pin 40 is rotated in place.

Reference marks 76, 78 may be engraved, etched, printed, or otherwise formed on surfaces of the base portion 12 and arm portion 14 that are positioned adjacent to one another when the arm portion 14 is in its upright position, as shown in FIG. 1.

Figure 8:
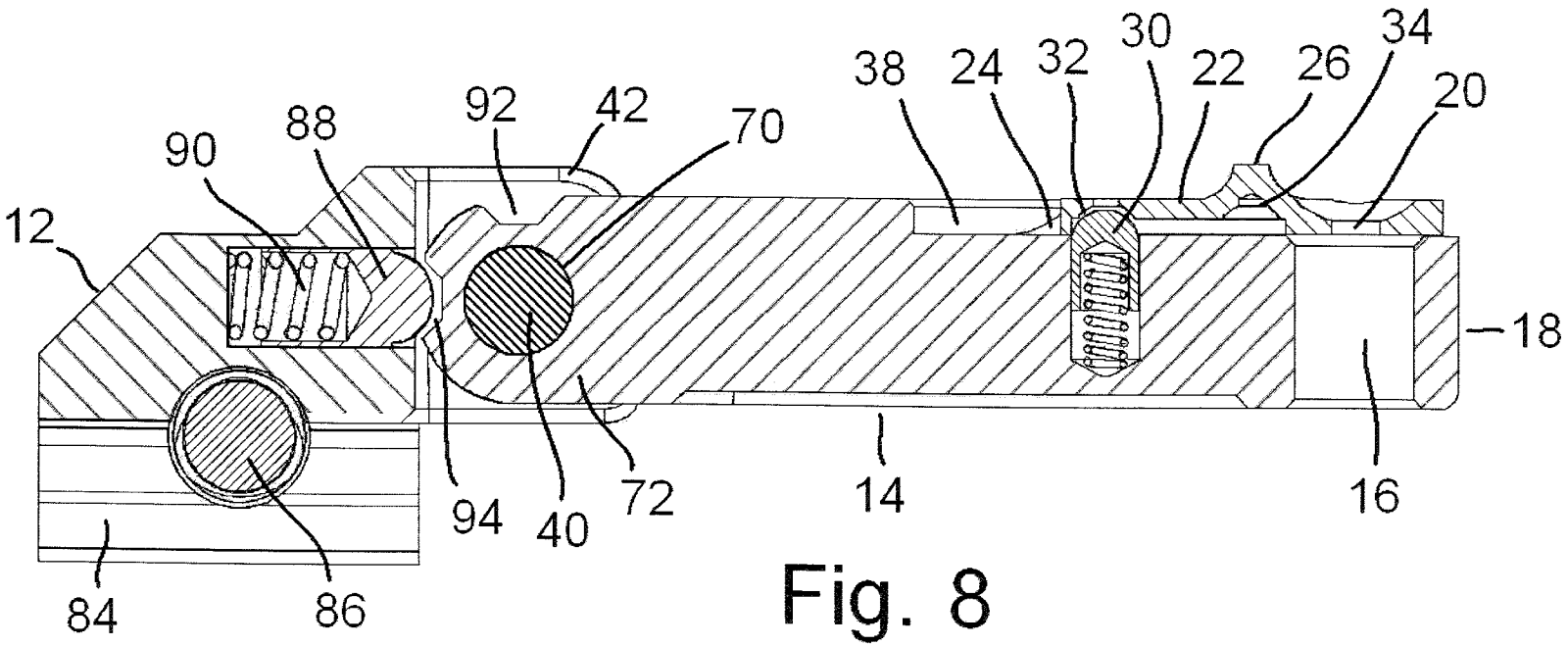
FIG. 8 is a side sectional view taken substantially along line 8-8 of FIG. 7 (with the mounting rail not shown).

The sight assembly 10 may be fastened to a firearm or accessory mounting rail by any of a wide variety of known mounting means. For example, a dovetail channel 82 may be provided in the base portion 12 to engage a mounting rail 80. Clamping force may be applied, such as by a movable jaw 84 drawn into place by a threaded fastener 86. As shown in FIGS. 3 and 8, the threaded fastener 86 may be positioned relative to the dovetail channel 82 such that it engages between lugs of the mounting rail 80 when installed.

Figure 7:
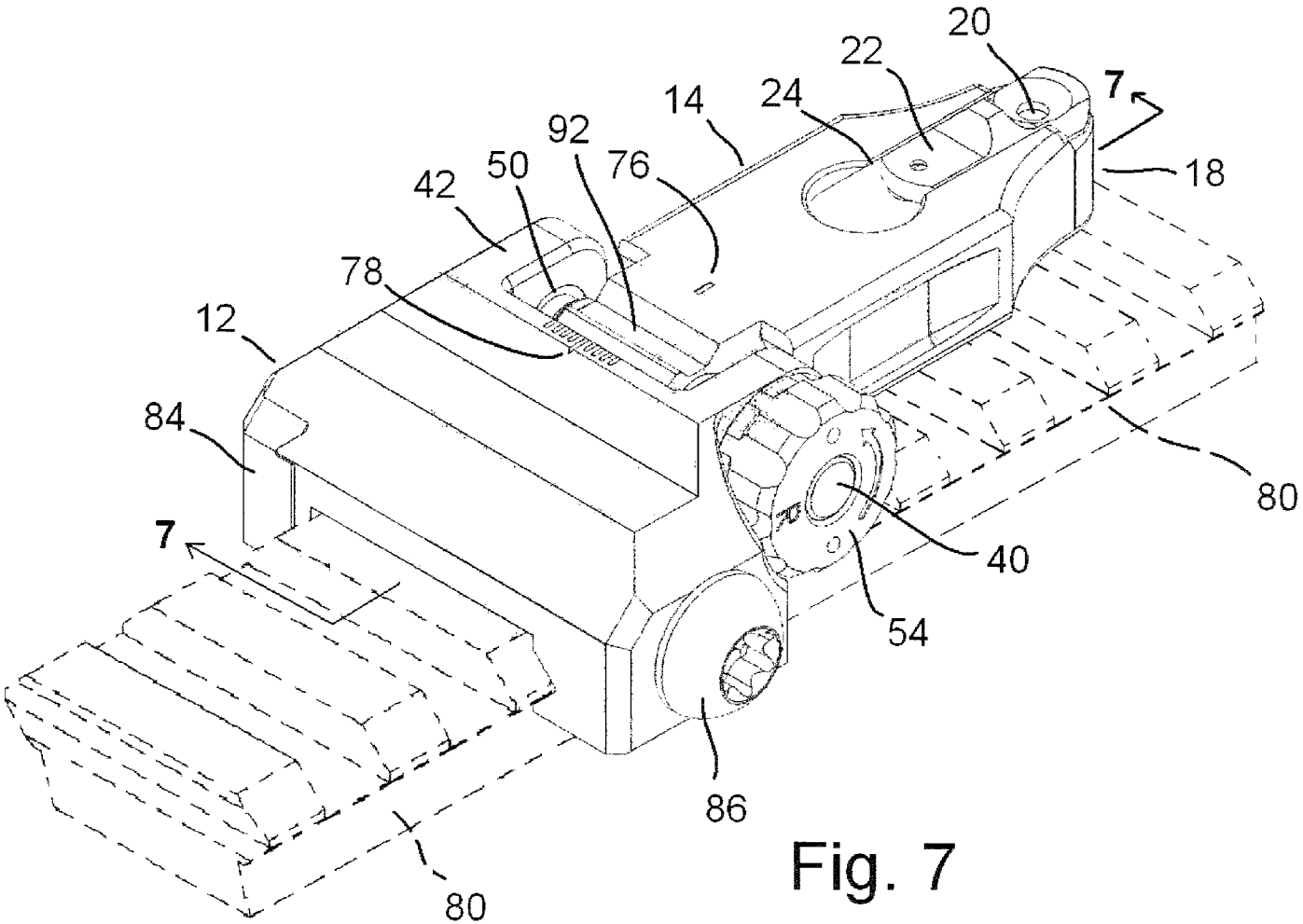
FIG. 7 is an isometric view of the sight in a folded position mounted to a Picatinny rail.

The arm portion 14 is movable between at least an extended position (FIGS. 1 and 3) and a folded position (FIGS. 7 and 8). Movement between these positions may be effected pivotally and the arm portion 14 may pivot on the previously described mounting pin 40. In order to facilitate the arm portion 14 being firmly held in either the deployed or folded position, while allowing easy manipulation between the positions without the use of a tool, a detent engagement, as further described below, may be used.

According to one embodiment, the base portion 12 may carry an elongated detent bar 88 that is spring biased by one or more springs 90 into engagement with either of at least first and second detent grooves 92, 94. These first and second detent grooves 92, 94 may be positioned, for example, at 90 degrees relative to one another and radial to the through-opening 70 and mounting pin 40.

As seen in FIGS. 7 and 8, when the arm portion 14 is in the folded position, the sight assembly 10 has a very low profile. Additionally, as previously mentioned, the selector member 22, which allows the user to select between the main aperture 16 and secondary aperture 20, may be in either position while the assembly 10 is folded, can be changed in position while the arm portion 14 is either deployed or folded, and does not require a change in position when the arm portion 14 is moved between folded and deployed positions.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A low-profile folding sight assembly, comprising:

a base configured to be secured to a gun;

an arm mounted on the base for pivotal movement between at least a folded position and a deployed position;

a first sighting aperture having a first size and situated adjacent a distal end of the arm;

a selector member on the arm having a second sighting aperture of a second size and linearly slidably movable between at least a first position in which the first sighting aperture is unobstructed and a second position in which the second sighting aperture is aligned with the first sighting aperture to present a reduced-size sighting aperture.

2. A low-profile folding sight assembly, comprising:

a base configured to be secured to a gun;

an arm mounted on the base for pivotal movement between at least a folded position and a deployed position;

a first sighting aperture having a first size and situated adjacent a distal end of the arm;

a selector member on the arm having a second sighting aperture of a second size and slidably movable between at least a first position in which the first sighting aperture is unobstructed and a second position in which the second sighting aperture is aligned with the first sighting aperture to present a reduced-size sighting aperture, wherein the selector member is slidably connected to the arm with a dovetail groove engagement for movement toward and away from the distal end.

3. The sight assembly of claim 2, further comprising a selector detent member configured to secure the selector member against inadvertent movement.

4. The sight assembly of claim 1, wherein the arm may be in the folded position while the selector member is in either position.

5. The sight assembly of claim 1, further comprising an arm detent member configured to retain the arm at the folded and deployed positions.

6. The sight assembly of claim 1, wherein the arm is adjustably positionable laterally relative to the base.

7. The sight assembly of claim 6, the base further comprising a laterally extending, rotatable mounting pin threadedly engaged with the arm such that rotation of the mounting pin causes lateral movement of the arm relative to the base.

8. A low-profile folding sight assembly, comprising:

a base configured to be secured to a gun;

an arm mounted on the base for pivotal movement between at least a folded position and a deployed position;

a first sighting aperture having a first size and situated adjacent a distal end of the arm;

a selector member on the arm having a second sighting aperture of a second size and slidably movable between at least a first position in which the first sighting aperture is unobstructed and a second position in which the second sighting aperture is aligned with the first sighting aperture to present a reduced-size sighting aperture, wherein the arm is adjustably positionable laterally relative to the base, the base further comprising a laterally extending, rotatable mounting pin threadedly engaged with the arm such that rotation of the mounting pin causes lateral movement of the arm relative to the base, further comprising at least one detent for retaining the mounting pin at selected rotational positions.

9. The sight assembly of claim 6, wherein at least one of the base and the arm includes indicia to indicate relative lateral position of the arm and base.

* * * * *